United States Patent [19]

Sinoff

[11] 4,359,161

[45] Nov. 16, 1982

[54] DISPLAY PACKAGE FOR A COMBINATION FISHING ROD AND REEL ASSEMBLY

[76] Inventor: Leonard Sinoff, 1307 Roosevelt Ave., Havertown, Pa. 19083

[21] Appl. No.: 314,765

[22] Filed: Oct. 26, 1981

Related U.S. Application Data

[63] Continuation of Ser. No. 119,526, Feb. 7, 1980, abandoned.

[51] Int. Cl.[3] ..... A01K 97/08

[52] U.S. Cl. ..... 206/315 R; 206/461; 150/52 R; 43/26

[58] Field of Search ..... 206/315 R, 461; 150/52 R; 43/26, 25

[56] References Cited

U.S. PATENT DOCUMENTS

| | | | |
|---|---|---|---|
| 2,532,119 | 11/1950 | Reynolds | 206/315 R |
| 3,933,241 | 1/1976 | Tassone et al. | 206/315 R |
| 3,967,730 | 7/1976 | Driscoll et al. | 206/461 |
| 4,005,776 | 2/1977 | Seeley | 206/461 |
| 4,106,621 | 8/1978 | Sorenson | 206/461 |
| 4,171,588 | 10/1979 | Hoffman et al. | 206/315 R |

FOREIGN PATENT DOCUMENTS

| | | | |
|---|---|---|---|
| 2821318 | 12/1978 | Fed. Rep. of Germany | 206/461 |
| 360647 | 2/1962 | Switzerland | 206/461 |

*Primary Examiner*—Joseph Man-Fu Moy

*Attorney, Agent, or Firm*—McAulay, Fields, Fisher, Goldstein and Nissen

[57] ABSTRACT

A display package for a combination fishing rod and reel assembly has a back support member, a front transparent member having a cavity substantially conforming to the configuration of the reel and adapted to be secured to the back member to form a display enclosure for the reel. In addition, the back member has U-shaped groove extending the full length thereof to reinforce the back member and also to receive the portion of the rod to which the reel is mounted, in order that the enclosure can be sealed closely. The result is a display package which completely encloses and contains the reel while it is mounted on the rod, to restrain pilferage and unauthorized tampering with the reel while the rod and reel assembly are on display. The handle and the free end of the rod extend outside the package to minimize the required package size.

A reinforcing rib is provided transverse to the U-shaped groove to further reinforce the package against pilferage.

6 Claims, 7 Drawing Figures

DISPLAY PACKAGE FOR A COMBINATION FISHING ROD AND REEL ASSEMBLY

This is a continuation of application Ser. No. 119,526, filed Feb. 7, 1980; now abandoned.

BACKGROUND OF THE INVENTION

1. Field of the Invention

This invention relates, to display packages for rod and reel assemblies and, more particularly, to a display package for preventing unauthorized access to a reel when the rod and reel assembly are displayed.

2. Description of the Prior Art

It is common to display a combination fishing rod and reel assembly for sale in department or sporting goods stores where the merchandise is often left unattended. The assembly is not wrapped in any protective packaging and is the subject of tampering and acts of vandalism. For example, a would be thief can quickly and easily loosen the fastening nut which secures the reel to the rod, and thereby remove the reel for purposes of theft. Portions of the unprotected reel, such as the handle or assembly nuts, are also the objects of vandalism which render the reel useless, and cause the loss of thousands of dollars each year to manufacturers and vendors of such merchandise.

Encapsulating packages are known, in general, but not the unique display package of the present invention. For example, U.S. Pat. No. 2,937,746 to Ferguson discloses a so-called "blister" pack for a fishing reel, but does not include any suggestion of attaching the rod to the reel, The complete item to be packaged is contained within the package and no portion extends outside the closure.

U.S. Pat. No. 3,809,226 to Ferrari, and U.S. Pat. No. 3,687,282 to Owen both disclose packages wherein a portion of the product is enclosed within a transparent receptacle while another portion of the product extends outside the receptacle. However, in neither case are the packages of such a nature as to restrain access to the products stored inside. Further, neither package shows the packaging of an item which extends outwardly of the package in two opposite directions, nor do they otherwise deal with the problems inherent in endeavoring to seal, from pilferage or from getting dirty, fishing rod and reel combination assemblies.

U.S. Pat. No. 4,136,478 to Wycosky does show a closure for the handle and reel of a fishing rod. However, the device does not have portions of the rod and rod handle extending from the package in opposite directions, nor is it intended as a display package. Rather, it is an easily removable cover for use and reuse by the consumer. Other containers for fishing gear are disclosed in U.S. Pat. No. 2,749,634 to McKern and U.S. Pat. No. 2,532,119 to Reynolds. However, these covers are not display packages nor are they intended to restrain pilferage or other unauthorized access to the reel, when they are used.

It is an object of the present invention to provide a display package for a combination fishing rod and reel assembly which permits sealing the reel while it is mounted on the rod. It is a related object to provide a display package which restrains unauthorized access to the reel, when the reel is on display. It is a further and related object of the invention to provide a display package which seals the reel from becoming dirty during display. It is still a further object of the invention to provide a package which minimizes the packaging material to reduce costs, while still effectively packaging the rod and reel assembles combination.

BRIEF DESCRIPTION OF THE INVENTION

The objects of the invention are attained in a display package including a back support member and a front transparent member adapted to be secured to the back support member.

The front member has a cavity substantially conforming to the configuration of the reel. The back support member includes a first support rib in the form of a U-shaped groove extending the full length thereof. This rib not only reinforces the back against tearing, but also receives therein a mid-portion of the rod to which the reel is mounted. When the front and back support members are disposed around a rod and reel assembly, and the front member is secured to the back support member, the result is a closely fitting package which restrains access to the reel and to the nut which locks the reel to the rod. In addition, because the rear support member conforms to the shape of the rod as the rod passes therethrough, and the front member conforms to the reel, the result is a close package which tightly seals the rod and reel assembly from entry of dirt.

A second support rib is preferably also formed in the back member and extends transversely to the first rib in which the rod is received. This stiffens the back member in a second direction to operate, in combination with the first rib, to restrain tearing and bending of the back member away from the front member and thereby restrict access into the enclosure.

The above brief description of the invention, together with the objects and features thereof will become more apparent from a consideration of the following detailed description when taken in conjunction with the accompanying drawings.

DESCRIPTION OF THE PREFERRED EMBODIMENT

Figure 1:
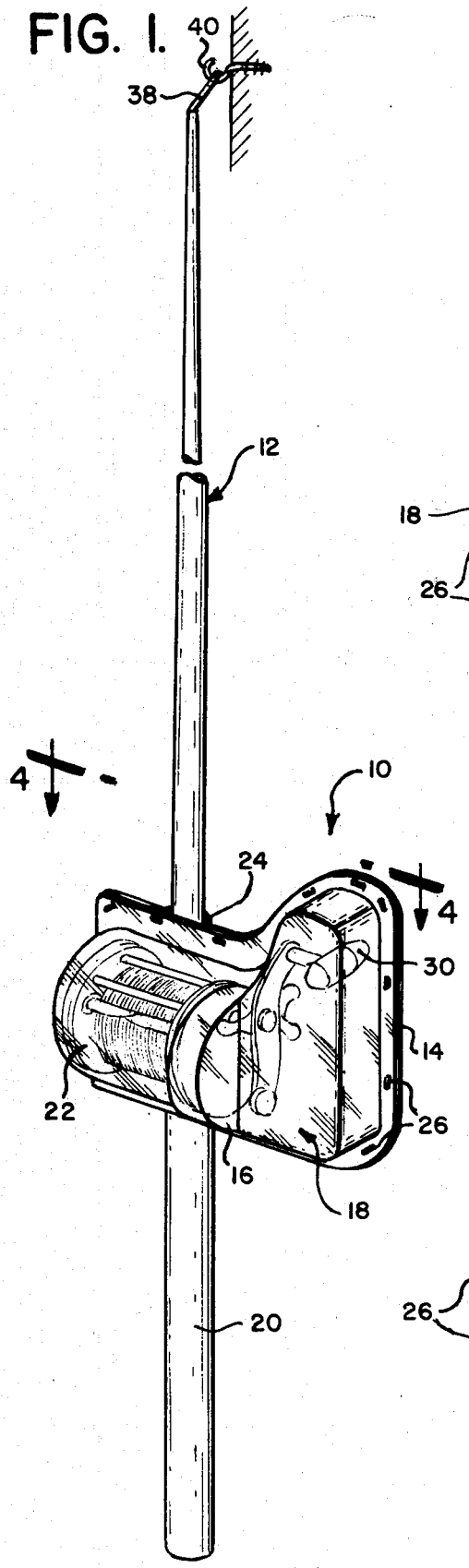
FIG. 1 is a perspective view of the display package of the present invention in place over a rod and reel.
Figure 2:
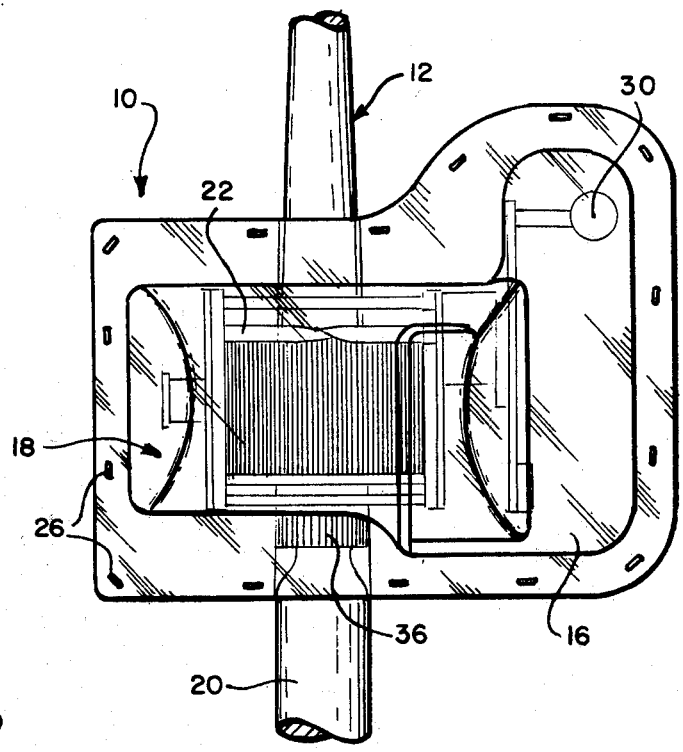
FIG. 2 is a front elevational view of the enclosed portion of the rod and reel assembly of FIG. 1.

With reference especially to FIGS. 1-3 and 6, a display package 10 for a combination fishing rod and reel assembly 12 has a generally flat back member 14 and a front member 16 wherein is defined a reel receiving cavity 18.

As illustrated in FIG. 1, the package 10 is intended for use with a rod and reel assembly 12 wherein the rod 20 and the reel 22 are secured together in their normal operative arrangement. One need only remove the package 10 from the rod and reel assembly 12 and he or she is ready to go fishing.

The present invention display package is intended to enclose closely the reel 22 and the mid-portion of the rod 20 to which the reel is mounted, for display, and to restrain unauthorized tampering with the reel 22. To avoid the need for a large package, the present invention package 10 has a rod receiving U-groove 24 formed the length of the back member 14 to receive the rod 20 therein. The ends of the U-groove 24 are open to permit the rod 20 to pass therethrough. This U-groove 24 also serves as a reinforcing rib for reinforcing the back member 14 against flexing and tearing whereby a pilferer may gain entrance to the reel receiving cavity 18. As illustrated in FIGS. 1–3 and 6, the preferred means for sealing the front member 16 to the back member 14 is by staples 26 although adhesives or heat sealing may also be used where applicable.

Figure 3:
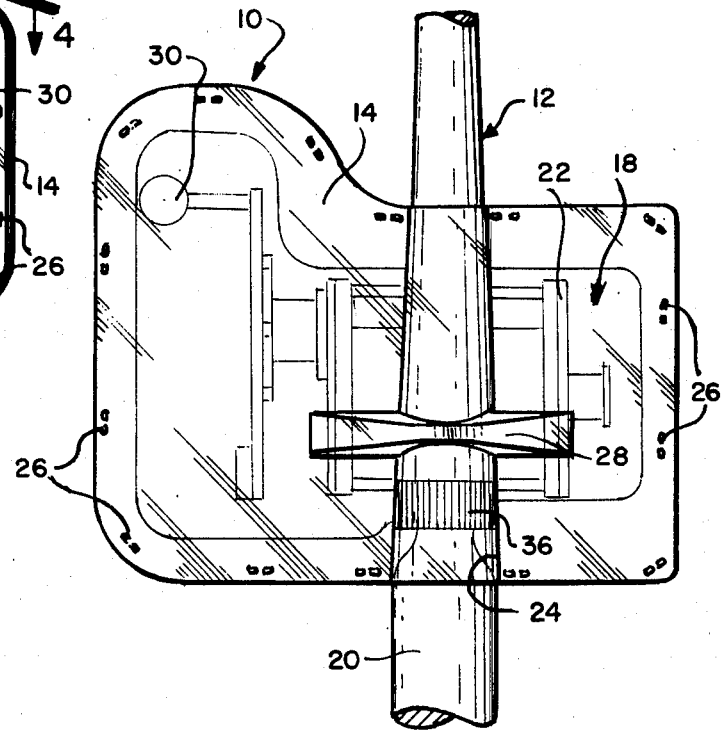
FIG. 3 is a rear elevational view of the package of FIG. 2.
Figure 4:
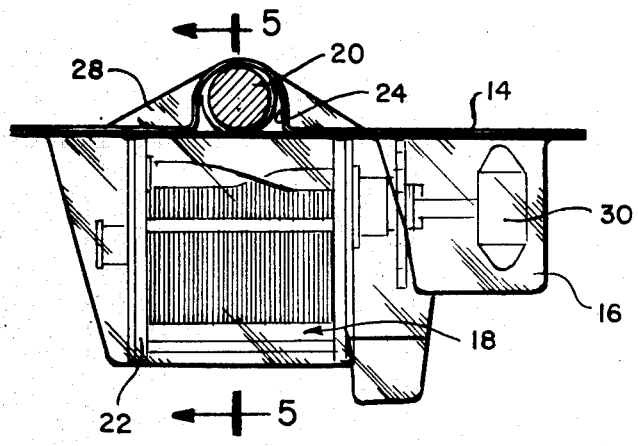
FIG. 4 is a sectional view through line 4—4 of FIG. 1.
Figure 5:
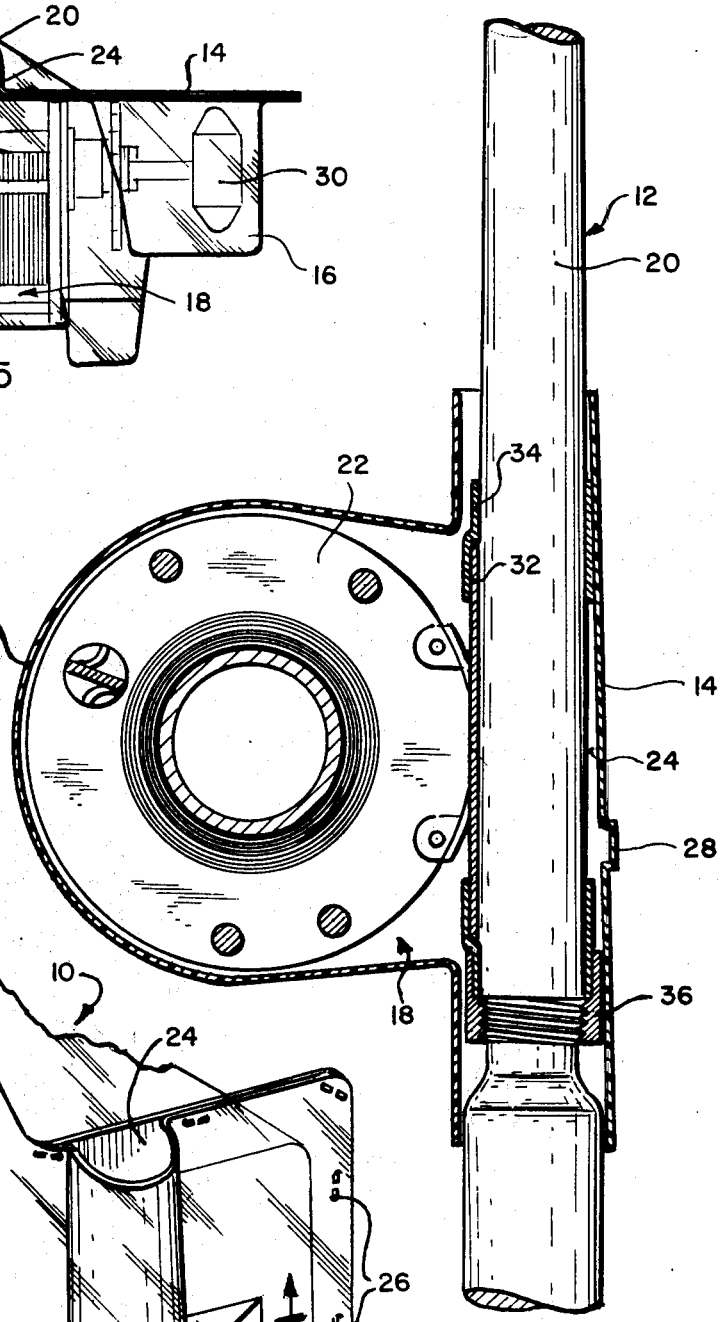
FIG. 5 is a sectional view through line 5—5 of FIG. 4.
Figure 6:
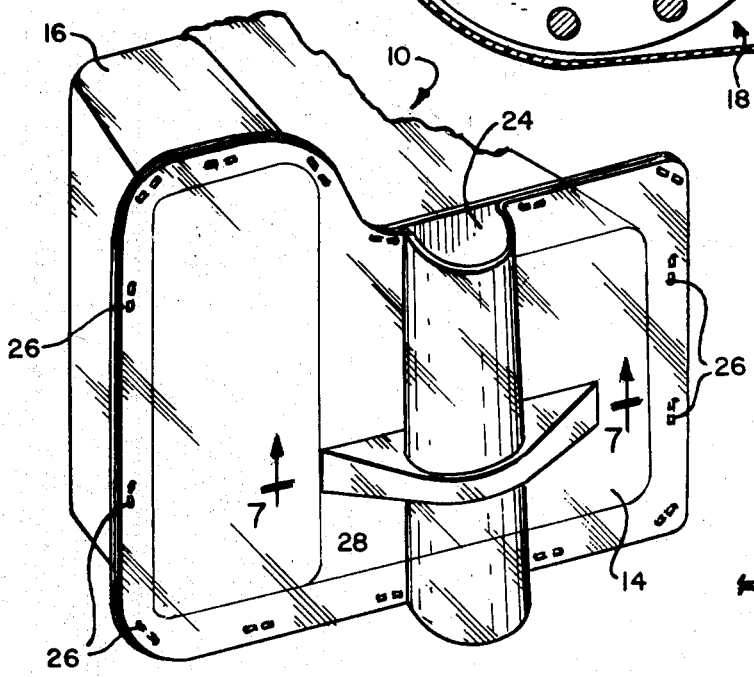
FIG. 6 is a rear prespective view of an assembled package without the rod and reel assembly.
Figure 7:
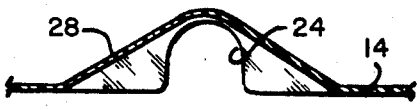
FIG. 7 is a sectional view through line 7—7 of FIG. 6

To further reinforce the back member 14 from flexure and tearing, a second reinforcing structure in the form of a rib 28 transverse to the U-groove 24 is provided in cooperation with U-groove 24. This is preferably disposed, as shown, at right angles to the U-groove 24 and across a mid section thereof (FIG. 3).

The reel receiving cavity 18 is formed to conform closely to the body of reel 22 and has an enlarged portion to receive the handle 30 of the reel 22. The back member 14 is sized large enough to overlap the edges of the front member 16 whereupon the overlapped edges are secured together by staples 26, or other means as discussed above, to form the closed package.

To use the display package 10, one first mounts the reel 22 to the rod 20, in the usual manner, for example by sliding the reel mounting plate 32 under a bracket 34 provided on the rod 20 and locking the other end of the reel mounting plate 32 with a reel nut 36. Thereafter, the front member is fitted over the reel and the back member 14 is fitted with the rod 20 received in the U-groove 24 therein. The back member 14 is aligned with the front member 16 and they are secured together with staples 26 or other securing means as are desired. As shown in the drawings, the closed package 10 surrounds and closely conforms both to the reel 22 and to the mid-portion of the rod 20. Furthermore, the opposite ends of the U-groove 24 cooperate with the front member 16, when the package 10 is closed, to define opposed openings in said package through which the rod 20 extends. The rod may then be displayed by a hook 38 or other means anchored to the display rack or wall, engaged with the upper line guide 38 normally provided on the end of a fishing rod 20 (see FIG. 1).

The front member 16 is suitably formed of a transparent material such as clear polyvinyl chloride. In this way the reel 22 is clearly visable for inspection by a perspective purchaser although it is not possible to handle the reel until the packaging 10 is removed. The back member 14 is conveniently made of the same polyvinyl chloride material although it is not necessary for the back member to be transparent and, in fact, it is contemplated that advertising or other informational material may be printed or secured thereto.

As will readily be realized, because of the reinforcing action of the U-groove rib 24 and the second rib 28, the display package 10 is relatively rigid and cannot be easily entered without cracking the packaging material or cutting open the package 10. This restrains casual pilfering or tampering with the reel, as easy entry is not available into the package. In addition, because the package is so designed as to only enclose the reel 22 and the portion of the rod 20 to which the reel is mounted, the cost of materials for the package 10 can be kept at a minimum. As shown in FIG. 1, the completed package, with the reel 22 in place on rod 20 can be displayed by simply hanging it from a hook 40. The package permits such assembled display without fear of casual pilferage or tampering.

The above is by way of illustration of the presently preferred embodiment and is not intended to be otherwise limiting. Other modification as would be obvious to a skilled artisan, are intended to be included within the scope of the invention.

What is claimed is:

1. A display package for a combination fishing rod and reel assembly, comprising:

(a) a back support member;

(b) a front member formed of transparent material and adapted to be secured to said back member to form a closed package;

(c) said back member having a U-shaped groove extending across the surface thereof to reinforce said back member and to receive therein a mid-portion of the rod to which the reel is mounted;

(d) a reinforcing rib formed in said back member transverse to said U-shaped groove to restrain tearing of said back member, whereby unauthorized access to the reel through said back member, by tearing, is prevented by the combined reinforcing action of said U-shaped groove and said reinforcing rib;

(e) said front member defining a cavity substantially conforming to the reel and adapted to receive the reel therein; and (f) said package when closed being adapted to surround and closely conform both to the reel and to said mid-portion of the rod; the opposite ends of said U-shaped groove cooperating with said front member, and when said package is closed, to define opposed openings in said package through which the rod extends to provide a pilfer-proof display package.

2. The display package of claim 1 wherein said reinforcing rib is substantially perpendicular to said U-shaped groove.

3. The display package of claim 1 or 2 wherein said reinforcing rib is disposed across a mid-portion of said U-shaped groove.

4. The display package of claim 1 further comprising a closure means operable to secure said front member to said back member.

5. The display package of claim 4 wherein said closure means comprises staples.

6. In combination, said display package of claim 1, 2, 4 or 5 and said combination rod and reel assembly.

* * * * *